United States Patent [19]

Nishigaki

[11] Patent Number: 4,514,224

[45] Date of Patent: Apr. 30, 1985

[54] TOUGH CARBIDE BASE CERMET

[75] Inventor: Kenichi Nishigaki, Urawa, Japan

[73] Assignee: Mitsubishi Kinzoku Kabushiki Kaisha, Tokyo, Japan

[21] Appl. No.: 554,168

[22] Filed: Nov. 22, 1983

Related U.S. Application Data

[63] Continuation of Ser. No. 208,539, Nov. 20, 1980, abandoned, which is a continuation of Ser. No. 919,289, Jun. 26, 1978, abandoned.

[30] Foreign Application Priority Data

Aug. 11, 1977 [JP] Japan ..... 52-95531

[51] Int. Cl.[3] ..... C22C 29/00; B22F 3/00

[52] U.S. Cl. ..... 75/238; 75/236; 75/241

[58] Field of Search ..... 75/236, 237, 238, 241, 75/242

[56] References Cited

U.S. PATENT DOCUMENTS

| | | | |
|---|---|---|---|
| 2,711,009 | 6/1955 | Redmond et al. | 75/241 |
| 3,409,419 | 11/1968 | Yates | 75/238 |
| 3,669,695 | 6/1972 | Iler et al. | 75/244 X |
| 3,741,733 | 6/1973 | Kieffer . | |
| 3,916,497 | 11/1975 | Doi et al. | 75/236 |
| 3,917,463 | 11/1975 | Doi | 75/236 |
| 3,981,062 | 9/1976 | Moskowitz | 75/237 |
| 4,019,874 | 4/1977 | Moskowitz | 75/241 |
| 4,022,584 | 5/1977 | Rudy | 75/234 |
| 4,065,301 | 12/1977 | Tanaka | 75/204 |
| 4,120,719 | 10/1978 | Nomura | 75/242 |

FOREIGN PATENT DOCUMENTS

| | | | |
|---|---|---|---|
| 50-106803 | 8/1975 | Japan | 75/244 |
| 52-2992 | 1/1978 | Japan | 75/238 |
| 859192 | 1/1961 | United Kingdom | 75/242 |

*Primary Examiner*—Ben R. Padgett
*Assistant Examiner*—Anne Brookes
*Attorney, Agent, or Firm*—Frishauf, Holtz, Goodman & Woodward

[57] ABSTRACT

A titanium carbide base cermet with a high toughness which consists essentially of, in weight percentage, a dispersed phase of from 70 to 95% free from chromium carbide, and a binder phase of from 5 to 30%;

(1) said dispersed phase consisting essentially of:
- (i) titanium nitride: from 10 to 25%,
- (ii) at least one of tungsten, molybdenum and carbides thereof: from 10 to 30%,
- (iii) zirconium carbide: from 0.2 to 5.0%,
- (iv) aluminum nitride: from 0.1 to 5.0%, and
- (v) A composite carbide produced by substituting at least one of tantalum carbide and niobium carbide for from 3 to 50% of titanium carbide: balance: and, (2) said binder phase consisting essentially of at least one metal of iron group and incidental impurities.

3 Claims, No Drawings

TOUGH CARBIDE BASE CERMET

This application is a continuation of application Ser. No. 208,539, filed Nov. 20, 1980, which, in turn, is a continuation of Ser. No.919,289, filed June 26, 1978 both now abandoned.

REFERENCE TO PATENTS, APPLICATIONS AND PUBLICATIONS PERTINENT TO THE INVENTION

So far as we know, the document pertinent to the present invention follows:

Japanese Patent Provisional Publication No. 65,117/77 of May 30, 1977 (Japanese Patent Application No. 140,277/76 of Nov. 23, 1976) corresponding to the U.S. patent application Ser. No. 634,972 of Nov. 24, 1975.

The contents of the prior art disclosed in the document listed above will be described later in the "Background of the Invention".

FIELD OF THE INVENTION

The present invention relates to a titanium carbide base cermet high in the strength and the toughness, and moreover, excellent in the wear resistance, the heat resistance and the corrosion resistance.

BACKGROUND OF THE INVENTION

Various studies have conventionally been carried out for the purpose of improving the toughness, the wear resistance and the corrosion resistance of a titanium carbide base cermet, and recently an improved titanium carbide base cermet was developed, which contains added titanium nitride (TiN) or titanium carbo-nitride (TiCN). More specifically, TiN is one of the most stable nitrides, together with zirconium nitride (ZrN) among transition metal nitrides, excellent in the strength at high temperatures, has such a high hardness as a Vickers hardness of 1,950 kg/mm$^2$, and is far superior to titanium carbide (TiC) in terms of the corrosion resistance. TiCN has also excellent properties similar to those of TiN. It is therefore considered that by adding TiN or TiCN having such excellent properties to a titanium carbide base cermet, the grain growth in the dispersed phase is largely inhibited at the time of sintering said cermet, and hence, improves the toughness of the titanium carbide base cermet.

The following cermet has been proposed:

a titanium carbide base cermet, disclosed in Japanese Patent Provisional Publication No. 65,117/77 of May 30, 1977 (Japanese Patent Application No. 140,277/76 of Nov. 24, 1976) corresponding to the U.S. patent application Ser. No. 634,972 of Nov. 24, 1975, which consists essentially of:

a dispersed phase of from 50 to 90 wt.% consisting essentially of titanium carbide and vanadium carbide as indispensable constituents, and at least one of chromium carbide, molybdenum carbide and titanium nitride; and a binder phase of from 10 to 50 wt % consisting essentially of nickel, molybdenum and aluminum (hereinafter referred to as "Reference 1").

Titanium nitride (TiN) is contained in Reference 1 as an optional constituent in the dispersed phase thereof. TiN has the function of improving the hardness and the toughness of a titanium carbide base cermet, as mentioned above, as well as of improving the wear resistance, especially the resistance to crater wear. On the other hand, however, if TiN is contained in the dispersed phase, it is inevitable that the wettability of the dispersed phase against the binder phase tends to be adversely affected. Addition of TiN alone cannot therefore always improve the toughness of a titanium carbide cermet as desired.

In Reference 1 the dispersed phase contains chromium carbide ($Cr_3C_2$) as an optional constituent. $Cr_3C_2$ has the function of improving the hardness of the dispersed phase as well as of improving the strength and the corrosion resistance of the binder phase by chromium produced through partial decomposition of $Cr_3C_2$, which dissolves into the binder phase to form a solid-solution therewith. Addition of $Cr_3Cr_2$ to the dispersed phase therefore improves the hardness, the heat resistance and the corrosion resistance of a titanium carbide base cermet, while deteriorating the toughness thereof.

In Reference 1 also, the binder phase contains aluminum (Al) as an indispensable constituent, Al dissolves into the binder phase to form a solid-solution therewith, and when the binder phase mainly comprises nickel, a $\gamma'$phase [$Ni_3Al(Ti)$] with fine grains is precipitated in the binder phase, thus strengthening the binder phase, as mentioned later. The aforementioned effect of Al addition is however limited to the strengthening of only the binder phase, and does not strengthen the dispersed phase.

With these facts in view, the conventional titanium carbide base cermet containing TiN has improved toughness, wear resistance and corrosion resistance as compared with those of a titanium carbide base cermet not containing TiN, under the effect of TiN addition. However, the conventional titanium carbide base cermet cannot be said to be provided with the creep resistance, the wear resistance and the impact resistance at high temperatures sufficient to serve as a material for a high-speed cutting tool which produces much heat, a hot forging die and a hot rolling roll.

SUMMARY OF THE INVENTION

An object of the present invention is therefore to provide a titanium carbide base cermet high in strength and toughness, and moreover, excellent in wear resistance, heat resistance, and corrosion resistance.

The principal object of the present invention is to provide a titanium carbide base cermet particularly excellent in creep resistance, wear resistance and impact resistance at high temperatures, which is adapted to serve as a material for a high-speed cutting tool which produces much heat, a hot forging die and a hot rolling roll.

In accordance with one of the features of the present invention, there is provided a titanium carbide base cermet with a high toughness which consists essentially of, in weight percentage, a dispersed phase of from 70 to 95% free from chromium carbide, and a binder phase of from 5 to 30%;

(1) said dispersed phase consisting essentially of:

(i) titanium nitride: from 10 to 25%, (ii) at least one of tungsten, molybdenum and carbides thereof: from 10 to 30%, (iii) zirconium carbide: from 0.2 to 5.0%, (iv) aluminum nitride: from 0.1 to 5.0%, and (v) a composite carbide produced by substituting at least one of tantalum carbide and niobium carbide for from 3 to 50% of titanium carbide: balance; and, (2) said binder phase consisting essentially of at least one metal of iron group and incidental impurities.

DETAILED DESCRIPTION OF PREFERRED EMBODIMENTS

From the aforementioned point of view, I have made intensive studies in an attempt to improve the strength of the dispersed phase itself, the wettability of the dispersed phase against the binder phase, and the high-temperature properties of the binder phase itself of the conventional titanium carbide base cermet containing titanium nitride, and thus to obtain a titanium carbide base cermet excellent in these properties at ambient temperature as well as in creep resistance, wear resistance and impact resistance at high temperatures, which is adapted to serve as a material for a high-speed cutting tool which produces much heat, a hot forging die and a hot rolling roll. As a result, I have obtained knowledge as described in the following items (a) to (d):

(a) When a titanium carbide base cermet containing titanium carbide (TiC) and titanium nitride (TiN) (including solid-solution of TiC and TiN) as constituents of the dispersed phase has added thereto a relatively small amount of zirconium carbide (ZrC), the hardness of the dispersed phase is improved as mentioned above, and the intergranular strength between the dispersed phase and the binder phase is increased thus resulting in a remarkable improvement in the wear resistance of the titanium carbide base cermet.

For example, a sintered cermet of which the dispersed phase comprises TiC+10 wt.% TiN shows a Vickers hardness of only 2,400 kg/mm$^2$, whereas a sintered cermet with the dispersed phase comprising TiC+10 wt.% TiN+1 wt.% ZrC shows a Vickers hardness of 2,950 kg/mm$^2$.

As mentioned above, chromium carbide ($Cr_3C_2$) has an effect upon addition similar to that of ZrC, but on the other hand, has a drawback of adversely affecting the toughness of a titanium carbide base cermet. It is not therefore desirable to add $Cr_3C_2$ to the dispersed phase.

(b) Tantalum carbide (TaC) and niobium carbide (NbC) have themselves a higher strength at high temperatures as compared with TiC and TiN. Addition of TaC and/or NbC to the dispersed phase of a titanium carbide base cermet used as a material for a high-speed cutting tool of which the cutting edge reaches a considerably high temperature during cutting can therefore remarkably improve the high-temperature strength of the titanium carbide base cermet.

(c) If at least one of tungsten (W), molybdenum (Mo) and carbides thereof (WC and $Mo_2C$) is added to a titanium carbide base cermet, the wettability of the dispersed phase against the binder phase is improved, thus resulting in the improvement of the toughness of the titanium carbide base cermet.

(d) Aluminum carbide (AlN) has generally been believed to have a low wettability against metals of the iron group such as iron, nickel and cobalt, which are constituents of a binder phase, and no attempt has been made to add AlN to a titanium carbide base cermet.

However, if AlN is contained in coexistence with TiC and TiN, AlN can have a very high wettability against metals of iron group. AlN thus contained mostly forms a dispersed phase together with the other constituents, while part of the AlN is decomposed into aluminum (Al) which in turn dissolves into the binder phase to form a solid-solution therewith. When the binder phase mainly comprises nickel (Ni), a $\gamma'$phase [$Ni_3Al(Ti)$] with fine grains compartible with Ni grains is precipitated in the binder phase and strengthens the binder phase. Furthermore, the major part of AlN which forms a dispersed phase together with the other constituents improves the strength of the dispersed phase, and in addition, if AlN contained in coexistence with TiC and TiN as mentioned above, the wettability of the dispersed phase is improved, and along with this, because AlN has relatively small coefficient of thermal expansion and frictional coefficient, the resistance to thermal shock and the wear resistance at high temperatures of the titanium carbide base cermet are largely improved.

It is thus possible, by adding AlN into the dispersed phase, to improve the strength of both the dispersed phase and the binder phase. On the contrary, if Al is contained as a constituent of the binder phase, as in the conventional titanium carbide base cermet, the effect of Al addition is limited to the strengthening of only the binder phase, and cannot strengthen the dispersed phase as in the case of AlN addition.

The present invention was made based on the findings described in items (a) to (d) above, and the titanium carbide base cermet of the present invention is characterized in that:

Said titanium carbide base cermet consists essentially of, in weight percentage, a dispersed phase of from 70 to 95% free from chromium carbide, and a binder phase of from 5 to 30%;

(1) said dispersed phase consisting essentially of:
- (i) titanium nitride: from 10 to 25%,
- (ii) at least one of tungsten, molybdenum and carbides thereof: from 10 to 30%,
- (iii) zirconium carbide: from 0.2 to 5.0%,
- (iv) aluminum nitride: from 0.1 to 5.0%, and
- (v) a composite carbide produced by substituting at least one of tantalum carbide and niobium carbide for from 3 to 50% of titanium carbide: balance; and (2) said binder phase consisting essentially of at least one metal of iron group and incidental impurities.

Now, the reasons for limiting the range of the chemical composition of the titanium carbide base cermet of the present invention as mentioned above are given below.

(A) Dispersed phase (1) Titanium nitride content:

As mentioned above, titanium nitride (TiN) is known to have the effect of reducing the frictional coefficient, when a titanium carbide base cermet is used as a material for a cutting tool, between said cermet and the workpiece, and thus improving the wear resistance, especially the resistance to crater wear of the titanium carbide base cermet, in addition to the effect of inhibiting the grain growth of the titanium carbide (TiC) phase.

However, with a TiN content of under 10 wt.%, the aforementioned effect cannot be obtained as desired. It is therefore necessary to add TiN in an amount of at least 10 wt.%. On the other hand, with a TiN content of over 25 wt.%, not only the wettability of the dispersed phase against the binder phase is adversely affected, causing a decrease in the toughness of the titanium carbide base cermet, but also the wear resistance is decreased. The TiN content should therefore be up to 25 wt.%.

(2) Content of tungsten, molybdenum, and carbides thereof:

Tungsten (W), Molydenum (Mo) and carbides thereof (WC and $Mo_2C$) are known, as mentioned above, to have the effect of improving the wettability of the disperesed phase against the binder phase, and hence improving the toughness of a titanium carbide base cermet.

However, when the content of at least one of W, Mo, WC and $Mo_2C$ is under 10 wt.%, the aforementioned effect cannot be obtained as desired. It is therefore necessary to add at least one of these constituents in an amount of at least 10 wt.%. On the other hand, if the content of one of these constituents is over 30 wt.%, the titanium carbide base cermet tends to have lower oxidation resistance and wear resistance. The content of at least one of these constituents should therefore be up to 30 wt.%.

(3) Zirconium carbide content:

Zirconium carbide (ZrC) is known, as mentioned above, to have the effect of improving the hardness of the dispersed phase as well as the intergranular strength between the dispersed phase and the binder phase, and thus remarkably improving the wear resistance, the heat resistance and the corrosion resistance of the titanium carbide base cermet.

However, with a ZrC content of under 0.2 wt.%, the aforementioned effect cannot be obtained as desired. It is therefore necessary to add ZrC in an amount of at least 0.2 wt.%. On the other hand, a ZrC content of over 5.0 wt.% causes decrease in the wettability of the dispersed phase against the binder phase, thus resulting in a lower toughness of the titanium carbide base cermet. The ZrC content should therefore be up to 5.0 wt.%.

There is a conventional titanium carbide base cermet containing chromium carbide ($Cr_3C_2$) as an additive, having an effect similar to that of ZrC as described above, singly or in combination with ZrC. It is certain that $Cr_3C_2$ has the function of improving the hardness of the dispersed phase as well as of improving the strength and the corrosion resistance of the binder phase by chromium produced through partial decomposition of $Cr_3C_2$, which dissolves into the binder phase to form a solid-solution therewith, while it exerts adverse effects on the toughness. When aluminum (Al) is employed as a constituent of the binder phase as in the conventional titanium carbide base cermet, it would pose no problem. However, as described later, in the titanium carbide base cermet of the present invention using aluminum nitride (AlN) as a constituent of the dispersed phase, chromium (Cr) produced by partial decomposition of $Cr_3C_2$ preferentially dissolves into the binder phase to form a solid-solution therewith. This prevents Al produced by partial decomposition of AlN from dissolving into the binder phase, and as a result, it is impossible to obtain the effect of strengthening the binder phase. Therefore, the titanium carbide base cermet of the present invention is characterized also in that the dispersed phase does not contain $Cr_3C_2$.

(4) Aluminum nitride content:

Alumium nitride (AlN) has the effect of improving the sintering property of a titanium carbide base cermet, and if contained in coexistence with TiC and TiN, largely the wettability of the dispersed phase against the binder phase, strengthens both the dispersed phase and binder phase, and thus remarkably improving the resistance to thermal shock and the wear resistance of the titanium carbide base cermet at high temperatures. The most important feature of the titanium carbide base cermet of the present invention lies in that AlN is added to the dispersed phase and the cermet contains AlN.

However, with an AlN content of under 0.1 wt.%, the aforementioned effect cannot be obtained as desired. It is therefore necessary to add AlN in an amount of at least 0.1 wt.%. On the other hand, with an AlN content of over 5.0 wt.%, Al produced by partial decomposition of AlN reacts with a metal of iron group, a constituent of the binder phase, and forms an intermetallic compound, resulting in the embrittlement of the titanium carbide base cermet. The AlN content should therefore be up to 5.0 wt.%.

(5) Amount of substitution of tantalum carbide and/or niobium carbide for titanium carbide:

Tantalum carbide (TaC) and niobium carbide (NbC) are known to have the effect of further improving the high-temperature strength property of titanium carbide (TiC), and also of improving the strength of the binder phase by tantalum (Ta) and niobium (Nb) produced by partial decomposition of TaC and NbC both of which dissolve into the binder phase to form the solid-solution therewith.

However, with the amount of substitution of TaC and/or NbC for TiC of under 3 wt.%, the aforementioned effects cannot be obtained as desired. Said amount of substitution should therefore be at least 3 wt.%. On the other hand, if said amount of substitution is over 50 wt.%, the wear resistance and the oxidation resistance of the titanium carbide base cermet tend to decrease. Said amount of substitution should therefore be up to 50 wt.%.

(6) Amount of dispersed phase:

The dispersed phase having the above-mentioned chemical composition is an indispensable constituent phase for imparting an excellent wear resistance and a high heat resistance to a titanium carbide base cermet.

However, if the amount of dispersed phase is under 70 wt.%, it is impossible to ensure a desired wear resistance of the titanium carbide base cermet. The amount of dispersed phase should therefore be at least 70 wt.%. On the other hand, if the amount of dispersed phase is over 95 wt.%, the wettability of the dispersed phase against the binder phase decreases, and many pores tend to occur in the titanium carbide base cermet, thus resulting in a decreased toughness of the titanium carbide base cermet. The amount of dispersed phase should therefore be up to 95 wt.%.

(B) AMOUNT OF BINDER PHASE

The binder phase, which consists essentially of at least one metal of iron group such as iron, nickel and cobalt, is an indispensable constituent phase for imparting a desired toughness to a titanium carbide base cermet. Particularly when the binder phase mainly comprises nickel (Ni), as mentioned above, not only aluminum nitride (AlN) added to and contained in the dispersed phase as a constituent thereof strengthens the dispersed phase, but also aluminum (Al) produced by partial decomposition of AlN dissolves into the binder phase to form the solid-solution therewith, causes precipitation of a $\gamma'$phase [$Ni_3Al$ (Ti)] of fine grains compatible with Ni grains in the binder phase, and strengthens the binder phase.

However, with an amount of binder phase of under 5 wt.%, desired toughness and strength cannot be ensured for titanium carbide base cermet. The amount of binder phase should therefore be at least 5 wt.%. On the other hand, if the amount of binder phase is over 30 wt.%, the relative amount of dispersed phase becomes too small, thus leading to a deteriorated wear resistance of the titanium carbide base cermet. Therefore, the amount of binder phase should be up to 30 wt.%.

Now, the titanium carbide base cermet of the present invention is described more in detail in comparison with reference titanium carbide base cermets by means of an example.

EXAMPLE

A composite carbide of titanium and tantalum [(Ti, Ta)C] powder with an avarage particle size of from 1 to 2 μm (TiC/TaC weight ratio=80/20), a titanium carbide (TiC) powder with an average particle size of from 1 to 2 μm, a titanium nitride (TiN) powder with an average particle size of from 1 to 2 μm, a tungsten carbide (WC) powder with an average particle size of 1.2 μm, a tungsten (W) powder with an average particle size of 0.6 μm, a molybdenum carbide ($Mo_2C$) powder with an average particle size of 1.0 μm, a molybdenum (Mo) powder with an average particle size of 0.7 μm, a nickle (Ni) powder with an average particle size of 1.5 μm, a cobalt (Co) powder with an average particle size of 1.0 μm, a zirconium carbide (ZrC) powder with an average particle size of 1.5 μm, an aluminum nitride (AlN) powder with an average particle size of from 1 to 3 μm, and an alumnum (Al) powder with an average particle size of 1.5 μm were used as material powders, and were blended to achieve the chemical compositions as shown in Table 1. The blended material powders thus obtained were milled and mixed in a ball mill to obtain a material powder mixture, which was formed by compression to prepare a green compact. Then, titanium carbide base cermets of the present invention 1 to 3 and reference titanium carbide base cermets 1 to 8 were obtained by sintering said green compact by holding it at a temperature of 1,430° C. for one hour under vacuum.

Chemical compositions and properties of the titanium carbide base cermets of the present invention (hereinafter referred to as the "cermets of the present invention") 1 to 3 and the reference titanium carbide base cermets (hereinafter referred to as the "reference cermets") 1 to 8 are also shown in Table 1. Table 1 indicates, as the properties of these cermets, measured values of the hardness representing the wear resistance, measured values of the deflective strength representing the toughness, and states of structure.

TABLE 1

| Kind of cermet | Chemical composition (wt. %) | | | | | | | | | | | | Properties | | |
|---|---|---|---|---|---|---|---|---|---|---|---|---|---|---|---|
| | (Ti, Ta)C | TiC | Tin | ZrC | AlN | WC | W | $Mo_2C$ | Mo | Al | Ni | Co | Hardness ($H_RA$) | Deflective strength | Structure |
| Cermet of the present invention | | | | | | | | | | | | | | | |
| 1 | 50 | — | 10 | 1 | 0.3 | 14 | — | 10 | — | — | 7.5 | Balance | 92.3 | 140 | Normal |
| 2 | 50 | — | 10 | 1 | 0.1 | 9 | 2 | 10 | 3 | — | 7.5 | Balance | 92.1 | 145 | Normal |
| 3 | 48.6 | — | 12 | 1 | 1.0 | 14 | — | — | 9.4 | — | 7.5 | Balance | 92.6 | 135 | Normal |
| Reference cermet | | | | | | | | | | | | | | | |
| 1 | — | 60 | — | — | — | 15 | — | 10 | — | — | 7.5 | Balance | 92.0 | 118 | Normal |
| 2 | — | 42.6 | 18 | — | — | 15 | — | — | 9.4 | — | 7.5 | Balance | 91.7 | 129 | Pores |
| 3 | — | 50 | 10 | — | — | 15 | — | 10 | — | — | 7.5 | Balance | 91.6 | 135 | Normal |
| 4 | — | 60 | — | 1 | — | 15 | — | 10 | — | — | 7.5 | Balance | 92.1 | 115 | Normal |
| 5 | — | 50 | 10 | 1 | — | 15 | — | 10 | — | — | 7.5 | Balance | 91.8 | 125 | Normal |
| 6 | 50 | — | 10 | 1 | — | 9 | 2 | 10 | 3 | — | 7.5 | Balance | 92.0 | 133 | Normal |
| 7 | 50 | — | 10 | 1 | — | 9 | 4 | 10 | — | 0.05 | 8.5 | Balance | 92.0 | 139 | Normal |
| 8 | 48.6 | — | 12 | 1 | — | 14 | — | — | 9.4 | 1.0 | 7.5 | Balance | 92.6 | 130 | Normal |

As shown in Table 1, the cermets of the present invention 1 to 3 show in all cases very high values of hardness and deflective strength, and the structures thereof are quite normal without any pores.

On the contrary to this, although the reference cermets 7 and 8 to which Al was added and containing Al in the binder phase have hardness, deflective strength and structure rather close to those of the cermets of the present invention, the reference cermet 7 show a slightly lower hardness, and the reference cermet 8 is inferior in the deflective strength. The reference cermets 1, 4 and 6, which show hardness values rather close to those of the cermets of the present invention, are inferior in deflective strength. The reference cermets 2 and 5 are inferior in hardness and deflective strength as compared with the cermets of the present invention, and the reference cermet 2 contains pores in its structure. The reference cermet 3, which has a deflective strength rather close to those of the cermets of the present invention, is inferior in hardness.

Subsequently, a continuous turning test and an intermittent turning test were carried out on tips made from said cermets of the present invention 1 to 3 and said reference cermets 1 to 8, under the following conditions:

(1) Continuous turning test conditions:
Work material: JIS (Japanese Industrial Standards)—SNCM 8,
Cutting speed: 220 m/minute,
Rate of feed: 0.45 mm/revolution,
Depth of cut: 1.5 mm
Cutting time: for 10 minutes
Geometry of the tip: CIS (Cemented Carbide Industrial Standards)—SNP 432 (horning: 0.1×−25°)
Atmosphere: no coolant;

(2) Intermittent turning test conditions:
Work material: JIS—SNCM 8,
Cutting speed: 100 m/minute,
Rate of feed: 0.3 mm/revolution,
Depth of cut: 1.5 mm
Cutting time: for 5 minutes,
Geometry of the tip: CIS—SNP 432 (horning: 0.1×−25°)
Atmosphere: no coolant.

Results of the above-mentioned turning tests are shown in Table 2.

TABLE 2

| Kind of cermet | Continuous turning test (Flank wear width) (mm) | Continuous turning test (Crater depth) (μm) | Intermittent cutting test Ratio of damaged tips (Number of damaged tips/tested tips) |
|---|---|---|---|
| Cermet of the present invention | | | |
| 1 | 0.06 | 15 | 0/6 |
| 2 | 0.08 | 10 | 0/6 |
| 3 | 0.05 | 10 | 1/6 |
| Reference cermet | | | |
| 1 | 0.12 | 90 | 6/6 |
| 2 | 0.19 | 65 | 5/6 |
| 3 | 0.20 | 75 | 4/6 |
| 4 | 0.10 | 45 | 3/6 |
| 5 | 0.11 | 50 | 2/6 |
| 6 | 0.10 | 40 | 3/6 |
| 7 | 0.09 | 32 | 1/6 |
| 8 | 0.08 | 21 | 2/6 |

As is clear from the results shown in Table 2, the tips made from the cermets of the present invention 1 to 3 show in all cases very small values of the flank wear width and the crater depth in the continuous turning test, and show a very small number of damaged tips such as 0 or 1 in the intermittent turning test.

In contrast to this, the tips made from the reference cermets 7 and 8 to which Al was added and containing Al in the binder phase, which show values of the flank wear width and the ratio of damaged tips rather close to those of the tips made from the cermets of the present invention, show large crater depths. In the tips made from the reference cermets 1 to 6, the flank wear width, the crater depth, and the ratio of damaged tips are all considerably larger than those of the tips made from the cermets of the present invention, thus proving that the cermets of the present invention have very excellent properties as compared with the reference cermets.

As described above in detail, the titanium carbide base cermet of the present invention, which is excellent in wear resistance and toughness, is well adapted to serve as a material for a cutting tool to be used not only for cutting applications widely ranging from low-speed cutting to high-speed cutting, but also for heavy-duty cutting such as milling. The titanium carbide base cermet of the present invention, being excellent not only in the aforenoted properties at ambient temperature, but also in creep resistance, wear resistance, and impact resistance at high temperatures in particular, is highly adapted to serve as a material for a high-speed cutting tool which produces much heat, a hot forging die and a hot rolling roll, and furthermore, being provided with high corrosion resistance, is suitable as a material for a structural member to be used under a corroding environment, thus providing industrially useful effects.

What is claimed is:

1. A tough carbide base cermet which consists essentially of a chromium carbide free dispersed phase of from 70 to 95% and a binder phase of from 5 to 30% with all percentages being by weight;

(1) said dispersed phase consisting essentially of (i) titanium nitride in an amount of from 10 to 25%, (ii) at least one of tungsten, molybdenum and carbides thereof in an amount of from 10 to 30%, (iii) zirconium carbide in an amount of from 0.2 to 5.0%, (iv) aluminum nitride of a particle size up to 3 μm in an amount of from 0.1 to 5.0%, (v) the balance being a composite carbide comprising (a) titanium carbide, and (b) at least one of tantalum carbide and niobium carbide in an amount of from 3 to 50% of said composite carbide; and (2) said binder phase consisting essentially of (vi) at least one metal selected from the group consisting of iron, cobalt and nickel and when (a) said at least one metal is only one metal, that metal is nickel and when (b) said at least one metal is more than one metal, at least one of said metals is nickel; and (vii) also containing aluminum, titanium and incidental impurities; and said tough carbide base cermet being produced by mixing powders of the materials (i), (ii), (iii), (iv), (v), (vi) and (vii), compressing said powder to form a green compact and then sintering at high temperature under vacuum to form said tough carbide base cermet.

2. The tough carbide base cermet of claim 1, wherein said binder phase contains nickel and cobalt.

3. The tough carbide base cermet of claim 2, wherein said nickel and cobalt are in substantially equal amounts by weight.

* * * * *